US007134429B2

(12) United States Patent
Mader et al.

(10) Patent No.: US 7,134,429 B2
(45) Date of Patent: Nov. 14, 2006

(54) METHOD AND DEVICE FOR CONTROLLING AN INTERNAL COMBUSTION ENGINE

(75) Inventors: Christian Mader, Gerlingen (DE); Stefan Michael, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/069,164

(22) Filed: Feb. 28, 2005

(65) Prior Publication Data

US 2005/0193996 A1 Sep. 8, 2005

(30) Foreign Application Priority Data

Mar. 5, 2004 (DE) ..... 10 2004 010 751
Sep. 15, 2004 (DE) ..... 10 2004 044 463

(51) Int. Cl.
*F02D 43/00* (2006.01)
*F02D 41/00* (2006.01)

(52) U.S. Cl. ..... 123/703; 123/688

(58) Field of Classification Search ..... 123/679, 123/703, 674, 486, 688; 73/118.2, 118.1, 73/117.3, 119 R, 1.06; 701/101, 102, 103, 701/106, 109, 99

See application file for complete search history.

(56) References Cited

U.S. PATENT DOCUMENTS 4,825,833 A * 5/1989 Ikeura et al. ..... 123/435
4,831,838 A 5/1989 Nagai et al.
5,099,817 A * 3/1992 Nakaniwa ..... 123/674
5,318,003 A 6/1994 Kadota
5,586,544 A * 12/1996 Kitamura et al. ..... 123/684
5,626,120 A * 5/1997 Akatsuka ..... 123/479
5,657,737 A * 8/1997 Ishida et al. ..... 123/674
5,915,368 A * 6/1999 Ishida et al. ..... 123/675
6,415,218 B1 * 7/2002 Shimada et al. ..... 701/103
6,431,160 B1 8/2002 Sugiyama et al.
6,792,927 B1 * 9/2004 Kobayashi ..... 123/673

FOREIGN PATENT DOCUMENTS

| | | |
|---|---|---|
| DE | 302 480 | 8/1919 |
| DE | 100 17 280 | 10/2001 |
| DE | 102 44 539 | 4/2004 |
| EP | 0 889 221 | 3/2004 |

* cited by examiner

*Primary Examiner*—Mahmoud Gimie
(74) *Attorney, Agent, or Firm*—Kenyon & Kenyon LLP

(57) ABSTRACT

A device and a method for controlling an internal combustion engine in which, starting from the comparison between a measured and an expected value for a lambda signal, a correction value is specified for a fuel signal characterizing the fuel quantity, or an air signal characterizing the air quantity. Depending on the operating state, an output signal of a characteristics map and/or the output signal of a closed-loop control are/is used as the correction value.

7 Claims, 3 Drawing Sheets

METHOD AND DEVICE FOR CONTROLLING AN INTERNAL COMBUSTION ENGINE

BACKGROUND INFORMATION

German Patent No. 100 17 280, for example, describes a method and a device for controlling an internal combustion engine. The patent describes a method and a device for controlling an internal combustion engine in which the oxygen quantity flowing into the internal combustion is determined with the aid of at least one model on the basis of at least one manipulated variable and at least one measured variable characterizing the condition of the air in an intake manifold. Furthermore, a signal regarding the oxygen concentration in the exhaust-gas tract is ascertained, which corresponds to the output signal of a lambda probe.

SUMMARY OF THE INVENTION

In the case of modern internal combustion engines, increasingly greater demands are placed on exhaust gas values and (fuel) consumption values. Production variances in the injection system and/or in the air-mass signal result in higher emissions of the vehicles, since the signals that are available for the regulation and/or control are faulty. Production variances in the injection system lead to deviations between the calculated and the actual injection quantities.

In a device and method for controlling an internal combustion engine, the present invention provides that a correction value for a fuel signal characterizing the fuel quantity, or an air signal characterizing the air quantity, be predefined on the basis of a comparison between a measured value and an expected value of a lambda value. Depending on the operating state, an output signal of a characteristics map and/or the output signal of a closed-loop control are/is used as correction value. A decision is made, preferably as a function of the operating state, whether either an output signal of a characteristics map or the output signal of a closed-loop control is used as correction value. This considerably reduces emissions. It is particularly advantageous in this context that, even if the measured lambda signal is unavailable, a correction is possible with the aid of the characteristics map. In the following, the fuel signal is also referred to as fuel quantity and the air signal is referred to as air quantity. It is particularly advantageous if, alternatively, either the fuel signal or the air signal is corrected, the selection being based on the operating state of the internal combustion engine. This makes it possible to preferably correct the signal having the greatest error.

In an especially advantageous realization, the characteristics map is adapted as a function of the output signal of a closed-loop control. In this way, new and precise characteristics-map values are constantly available. In an especially simple realization, the closed-loop control is based on the comparison between the measured and the expected value for a lambda signal.

Given a lambda probe that is ready for operation, and/or in steady-state operation, it is the output signal of the closed-loop control that is preferably utilized. This allows the air quantity or the fuel quantity to be precisely controlled or regulated in these operating ranges. In operating states during which the lambda probe is not operative and/or in non-stationary dynamic operating states, an accurate control is possible via the characteristics map.

Since the output signal of the characteristics map and the output signal of the closed-loop control are superposed in the sense of a precontrol, an accurate control of the air quantity and the fuel quantity is possible even in dynamic operating states during which the closed-loop control responds with a delay due to system running times.

DETAILED DESCRIPTION

Figure 1:
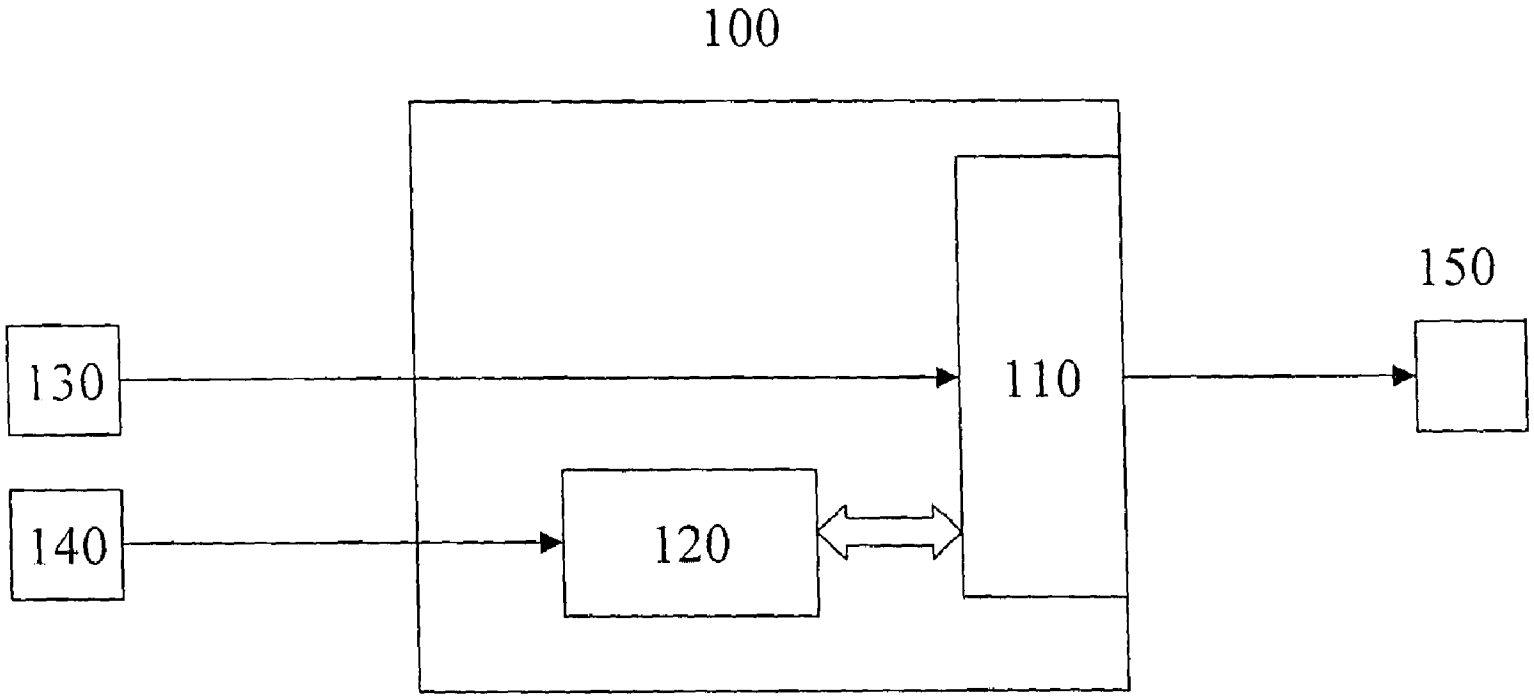
FIG. 1 shows a block diagram of the device according to the present invention.

FIG. 1 shows the important elements of a device for controlling an internal combustion engine in the form of a block diagram. A control unit is denoted by reference numeral 100. Among others, it includes a control-variable setpoint selection 110 and a model 120. The output signals from first sensors 130 and second sensors 140 are forwarded to control unit 100. The first sensors apply signals mostly to control-variable setpoint selection 110, and second sensors 140 apply signals to model 120. This representation is only an example, since various sensors are able to apply signals both to control-variable setpoint selection 110 and to model 120.

Control-variable setpoint selection 110 applies trigger signals to at least one actuating element 150. The at least one actuating element 150 determines the fuel quantity to be injected, the time and/or the end of fuel metering. Furthermore, additional actuating elements may be provided, which are able to influence the exhaust-gas recirculation rate or other operating parameters, for instance.

Model 120 exchanges various signals with control-variable setpoint selection 110.

On the basis of the sensor signals, which characterize various operating parameters, control-variable setpoint selection 110 calculates trigger signals to be applied to actuating element 150 or actuating elements 150. Different variables are calculated by model 120 on the basis of operating parameters or signals that are available within control-variable setpoint selection 110, using one or a plurality of model(s). Such a model is known from German Patent No. DE 100 17 280, for instance. Control-variable setpoint selection 110 considers the calculated variables when specifying the trigger signals for actuating elements 150.

Figure 2:
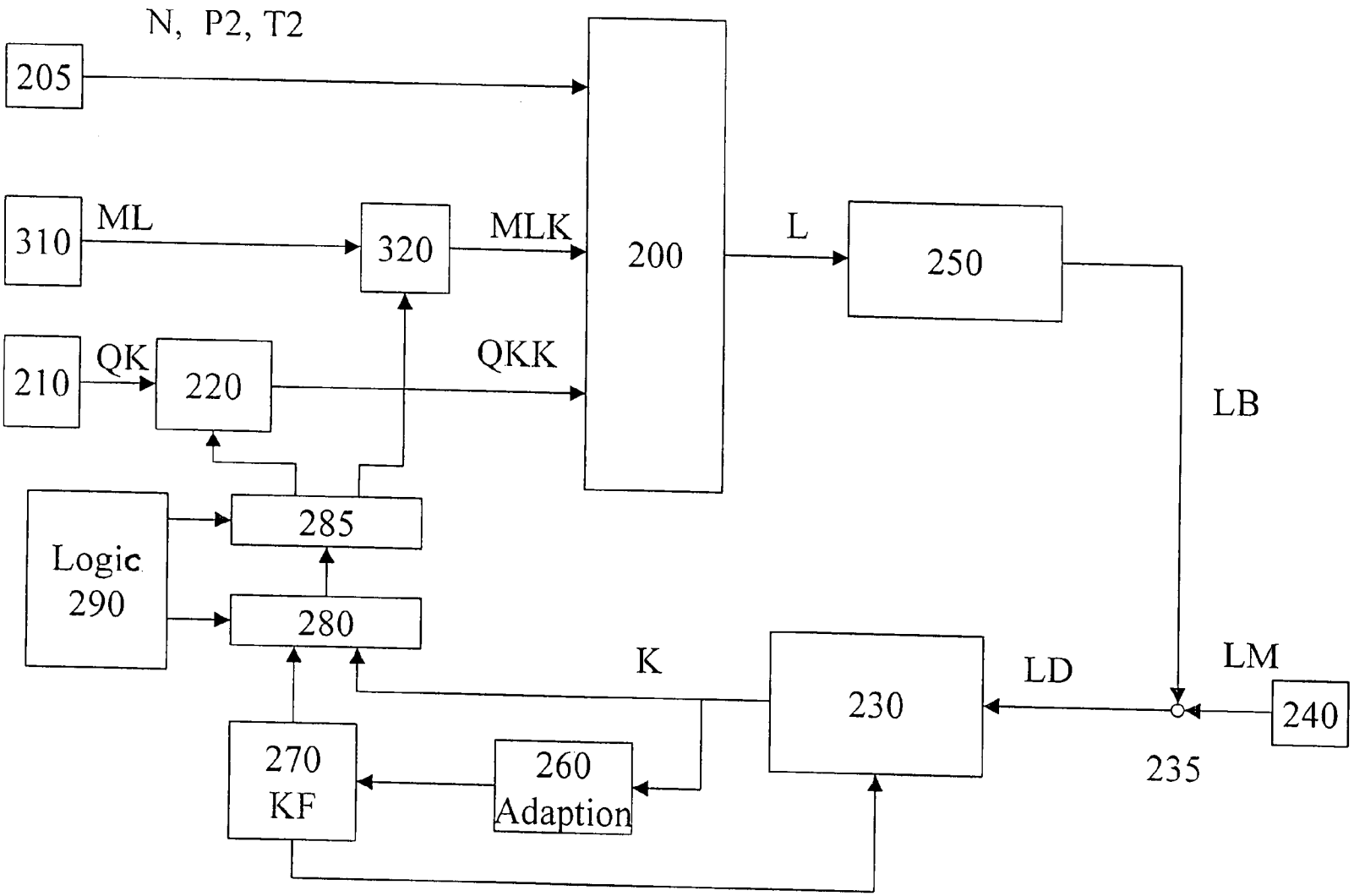
FIG. 2 shows a specific embodiment of the procedure of the present invention.

FIG. 2 shows an embodiment of the procedure according to the present invention. A model of the air system bears reference numeral 200 and is supplied with output signals N, P2 and T2 from a first signal setpoint selection 205. Via a correction device 320, output signal ML of a second signal setpoint selection 310 reaches model 200 of the air system. Furthermore, output signal QK of a third signal setpoint selection 210 reaches the model of the air system via a correction device 220. Hereinafter, the model of air system 200 is also referred to as first model. Output signal L of the first model is applied to a sensor model 250, which is also referred to as second model. Output signal LB of sensor model 250 arrives at a closed-loop control 230 via a node 235. The output signal of closed-loop control 230 reaches the second input of correction device 220. Also available at node 235 is output signal LM of a lambda sensor 240.

Output signal LB of the sensor model, which corresponds to the corrected estimated value of the first model, is compared in node 235 to output signal LM of the lambda sensor. The deviation of these two values is a measure for the instantaneous injection-mass fault or the air-mass fault. This means, if the deviation is zero, i.e., output signal LB (LB is compared to LM) of second model 250 and output signal LM of the lambda sensor are equivalent, the fuel mass processed by the model corresponds to the actual fuel mass. If the two values deviate from one another, closed-loop control 230 specifies a correction value K by which fuel-mass signal QK is corrected until corrected fuel-mass signal QKK corresponds to the actually injected fuel mass.

Model 250 simulates the dynamic response of sensor 240. Variables LB and L are identical in steady-state operation and deviate from one another only during dynamic operation. This second model 250 may also be omitted in a simplified embodiment.

Output signal K of closed-loop control 230 arrives at an adaptation 260, on the one hand, and a first switching means 280, on the other hand. The output signal of adaptation 260 reaches a characteristics map 270. The output signal of characteristics map 270 is applied to the second input of first switching means 280. The output signal of the first switching means is applied to a second switching means 285, which in turn alternatively applies the output signal of the closed-loop control or the output signal of characteristics map 270 to correction 220 or correction 320. First switching means 280 and second switching means 285 are controlled by logic 290. Depending on the setting of second switching means 285, the fuel quantity or the air quantity will be corrected as a function of the comparison between the expected lambda signal and measured lambda signal LM. Depending on the setting of first switching means 280, output signal K of closed-loop control 230 or the output signal of characteristics map 270 is used directly to correct the fuel quantity or the air quantity, the output signal being adapted as a function of the output signal of closed-loop control 230.

In an especially advantageous embodiment, the output signal of characteristics map 270 may be used for the precontrol, i.e., the correction signal is made up of the output signal of the characteristics map and the output signal of the closed-loop control, which is a function of the deviation between expected and measured value.

First signal setpoint selection 205 preferably constitutes sensors for detecting a rotational-speed signal N of the internal combustion engine, a pressure signal P2, which characterizes the pressure in the intake manifold of the internal combustion engine, and/or a temperature signal T2, which characterizes the air in the intake manifold. Signal ML, which characterizes the air mass supplied to the internal combustion engine, is preferably provided by a sensor 310.

The second signal-setpoint selection is a control-variable setpoint selection which provides signal QK that characterizes the fuel mass to be injected. Via correction device 220, this signal QK arrives at model 200 as well, which corresponds to model 120 in FIG. 1. This model 200 of the air system, first of all, supplies different variables to control-variable setpoint selection 110 required for specifying the control signals for the actuating elements. Furthermore, the first model supplies a signal L, which corresponds to the oxygen concentration in the exhaust gas.

Signal ML, which characterizes the air mass supplied to the internal combustion engine, and signal QK, which characterizes the fuel mass to be injected, also arrive at control-variable setpoint selection 110. On the basis of these signals, control-variable setpoint selection 110 controls corresponding actuating elements so as to influence the injected fuel quantity and/or the supplied air quantity.

Output signal L of the model is corrected by sensor model 250. Signal LB thus corrected will then be compared in node 235 with output signal LM of a lambda sensor. On the basis of difference LD of the two signals, closed-loop control 230 determines a correction value K to correct fuel-mass signal QK.

The model of the air system uses the following formula, among others:

$$L=ML/(14.5*QK).$$

This formula indicates the correlation between lambda signal L, air-mass signal ML and injection quantity QK. Air-mass signal ML and lambda value L are sensor signals. This correlation applies only to steady-state operating points.

Due to system-time constants, deviations from the above formula result in dynamic processes. If these system-time constants are not taken into account, the above formula allows the injection mass to be determined only in steady-state operation. This means that the deviation between the actually injected fuel quantity and desired fuel quantity QK may be determined only in steady-state operating states and a correction value K be determined on the basis of this deviation.

The procedure of the present invention makes it possible to determine a corresponding correction value K in non-steady-state operating states as well. To this end, it is provided that the system-time constants of the air system be simulated with the aid of first model 200 as well. The first model considers the system-time constants of the air system with the aid of a model. This means that the model provides an estimated value for the oxygen concentration in the exhaust gas on the basis of the input variables.

Sensor 240 for measuring the oxygen concentration has a characteristic transmission behavior, which the sensor model takes into account. In other words, the sensor model adapts the output signal of the model to the output signal of the sensor. This means that output signal LB of the sensor model has the same time characteristic as output signal LM of the sensor.

According to the present invention, the output signal of closed-loop control 230 and a characteristics-map-based correction signal are combined. During dynamic operation, the closed-loop control provides correction values for the air mass or the injection quantity. In the absence or during a malfunction of the lambda-sensor signal required for the control, the characteristics map minimizes the deviation.

According to the present invention, correction values K calculated by closed-loop control 230 are learned in characteristics map 270. The correction values are stored in characteristics map 270 preferably as a function of at least rotational speed N and fuel quantity QK to be injected. If the lambda sensor is not available, the air mass or the injection quantity may be corrected by characteristics map 270. In this case, first switching means 280 selects the output signal of characteristics map 270.

The lambda closed-loop control has poor dynamic response due to the high system-time constants. The transient response in dynamic operating states is considerably improved by precontrol values provided by characteristics map 270. This allows a rapid and exact specification of the correction values. If the lambda sensor is not operative yet, the air mass or the injection quantity is corrected on the basis of values stored in characteristics map 270. Due to these improvements compliance with the emission-limit values will be ensured even when the lambda-sensor signal is temporarily unavailable.

Model 250 calculates from sensor data of the operating states of the internal combustion engine a dynamically corrected lambda signal LB, which is also referred to as expected lambda signal in the following. This expected or calculated lambda signal is subtracted from measured signal LM of the lambda sensor and supplied to the input of closed-loop control 230. The closed-loop control minimizes the deviation between the measured and the expected lambda signal by intervening in a correcting manner in measured air mass ML or injection quantity QK. Once they are corrected, these two variables allow a precise control of the exhaust-gas recirculation.

According to the present invention it is possible to correct either the air-mass signal or the injection quantity as a function of the lambda signal. It is particularly advantageous that a precise control via characteristics map 270 is possible even in operating states in which the lambda sensor is not operative. This allows an exact control of the combustion engine also in operating states during which the lambda sensor is not ready for operation, for instance during a cold start or in the presence of a defect.

Figure 3A:
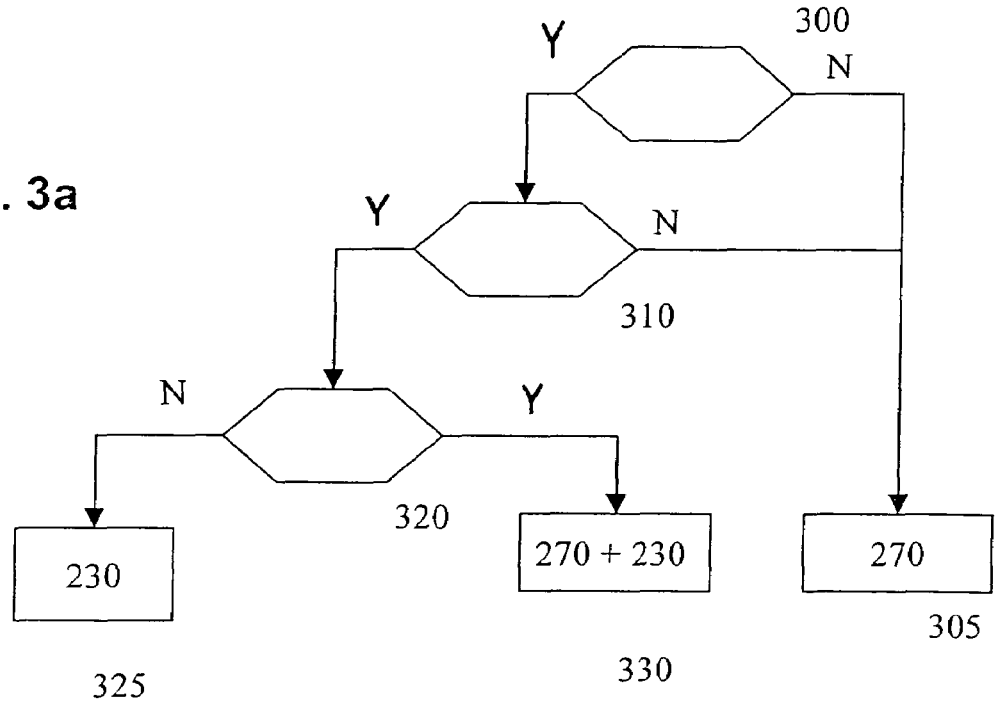
FIGS. 3*a* and 3*b* show a flow chart of a specific embodiment of the procedure according to the present invention.

FIG. 3 illustrates the method of functioning of logic 290 in detail on the basis of flow charts. In a first step 300, it is ascertained whether lambda sensor 240 operates in a fault-free manner. If this is not the case, switching means 280 forwards the output signal of characteristics map 270 to second switching means 285 in step 305. If the lambda sensor is operating properly, it is ascertained in step 310 whether the lambda sensor is already functional and ready for operation. If this is not the case, step 305 will follow in which the output signal of characteristics map 270 is used for the correction.

If the lambda sensor is functional, it is determined in step 320 whether a dynamic operating state is present. Such a dynamic operating state exists, for instance, if the rotational speed and/or the fuel quantity or another operating parameter changes by more than a threshold value. If this is not the case, i.e., no dynamic operating state is present, switching means 280 is controlled in such a way in step 325 that the output signal of closed-loop control 230 arrives at second switching means 285. If query 320 detects that a dynamic operating state is present, in step 330, the output signal of characteristics map 270 is superposed by the output signal of closed-loop control 230, in the sense of a precontrol.

Figure 3B:
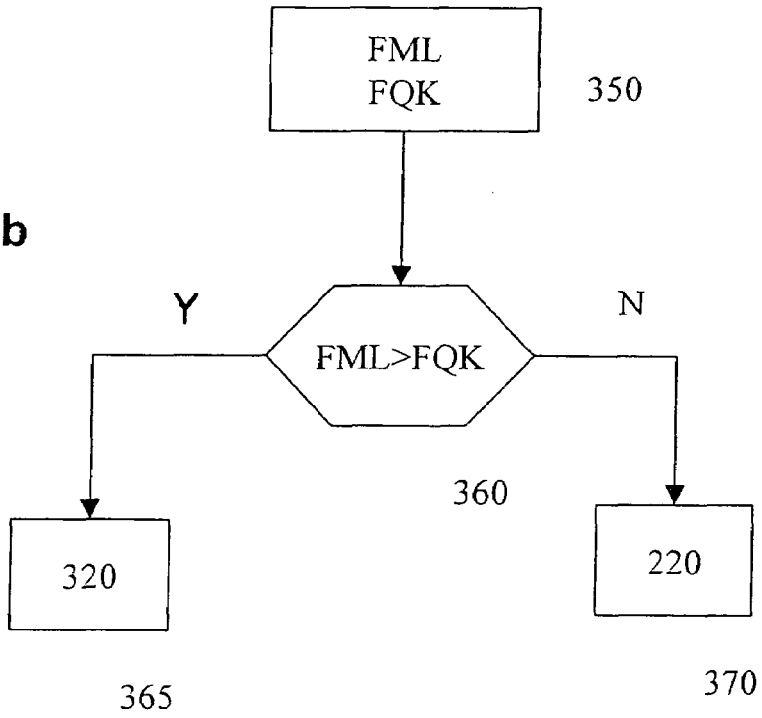

FIG. 3*b* illustrates a possible specific embodiment of the control of second switching means 285. In a first step 350, faults FML of the air quantity and fault GQK of the fuel quantity are ascertained.

Query 360 checks whether fault FML of the air quantity is greater than fault FQK of the fuel quantity. If this is the case, the air quantity will be corrected in step 365. If this is not the case, i.e., the fault of the fuel mass is greater than that of the air mass, the fuel quantity will be corrected in step 370.

The choice whether air quantity ML is corrected in step 365 or fuel quantity QK is corrected in step 370 depends on the size of the injection quantity or the air mass. The injection quantity has an approximately constant offset, which in the case of low quantities produces a greater relative fault than the air mass fault. According to the present invention, it is therefore experimentally ascertained, as a function of the operating point of the internal combustion engine, which value fault FML of the air quantity and/or fault FQK of the fuel quantity assumes. These values are stored in a characteristics map. During continuous operation, the values are read out. On the basis of the read-out values the query decides which correction will be carried out.

In a refinement, instead of query 360, it may also be provided that it is read out directly from a characteristics map as a function of the operating state which correction will be implemented.

According to the present invention, it is optionally the fuel signal or an air signal that is corrected by a correction value as a function of the operating state. Depending on the operating state, an output signal of a characteristics map and/or a closed-loop control is used as correction value. Preferably used as operating state are the fuel quantity, the air quantity, the rotational speed and/or a torque variable characterizing the desired torque. One or a plurality of these variables is preferably utilized. Apart from these variables, other variables may be analyzed as well.

In one refinement according to the present invention, it is provided that an appropriate correction value be stored in the characteristics map as a function of the operating state, such as, in particular, rotational speed N and injected fuel quantity QK, this correction value being adapted as a function of the output signal of a closed-loop control. It is particularly advantageous if closed-loop control 230 is used for the adaptation. As an alternative, instead of the lambda signal, other variables such as the rotational speed, for instance, may be used to adapt the characteristics map.

Given a lambda probe that is ready for operation and/or in steady-state operation, it is especially advantageous to utilize the output signal of the closed-loop control. However, if the lambda sensor is not functional, the output signal of the characteristics map is used. This allows a precise control even in the case of a non-functional lambda sensor. Such a non-functional lambda sensor is present in particular if the lambda sensor is defective or, in a cold start, is not functional yet. It is especially advantageous if in certain operating states, for instance in dynamic operating states, the characteristics map is used to precontrol closed-loop control 230.

In the case of a valid lambda signal, i.e., the lambda sensor is operative and not defective, the correction is implemented solely via closed-loop control 230. In the process, an intervention in the air mass or the injection quantity takes place. In this operating state, correction values K, calculated by the closed-loop control, are simultaneously adapted or learned in characteristics map 270 as a function of the engine speed and the injection quantity. A corresponding learning algorithm is known from German Patent No. DE 302 480, for instance.

If the lambda sensor is defective or not operative, the correction values from adapted characteristics map 270 will be utilized. The switchover between the use of the characteristics map or the closed-loop control preferably is made as a function of the analysis of the system state, which indicates an invalid sensor signal, for instance. The availability of such a replacement value of characteristics map 270 ensures a continuous correction in virtually all operating states.

Characteristics map 270 may have a different number of nodes, depending on the availability of resources and the requirements. Instead of a characteristics map, it is also possible to adapt a correction plane that spans several learning points. A corresponding procedure is known from R. 27974. In an analogous manner, the correction planes may also be realized via an algorithm, a corresponding procedure being known from German Patent No. DE 102 44 539. In a simplified embodiment, instead of a characteristics map, a characteristic curve concerning the quantity or the engine speed is also able to be realized or, in a more involved realization, a characteristic space may be realized concerning additional operating parameters such as the engine temperature.

What is claimed is:

1. A method for controlling an internal combustion engine comprising:

specifying a correction value for one of a fuel signal characterizing a fuel quantity and an air signal characterizing an air quantity as a function of a comparison between a measured value and an expected value for a lambda signal;

depending on an operating state, using as the correction value at least one of an output signal of a characteristics map and an output signal of a closed-loop control; and providing an option of correcting one of the fuel signal and the air signal depending on the operating state, wherein the option of correcting the one of the fuel signal and the air signal is provided based on which signal has a greatest error for the operating state.

2. The method according to claim 1, further comprising adapting the characteristics map as a function of the output signal of the closed-loop control.

3. The method according to claim 1, further comprising, given a lambda probe that is at least one of (a) ready for operation and (b) in steady-state operation, utilizing the output signal of the closed-loop control.

4. The method according to claim 1, further comprising superposing the output signal of the characteristics map and the output signal of the closed-loop control in the sense of a precontrol.

5. The method according to claim 1, wherein the air signal is corrected if an air-mass fault is greater than a fuel-quantity fault.

6. The method according to claim 1, wherein the fuel signal is corrected if an air-mass fault is less than a fuel-quantity fault.

7. A device for controlling an internal combustion engine comprising:

means for specifying a correction value for one of a fuel signal characterizing a fuel quantity and an air signal characterizing an air quantity as a function of a comparison between a measured value and an expected value for a lambda signal;

means for utilizing as the correction value at least one of an output signal of a characteristics map and an output signal of a closed-loop control, depending on an operating state; and means for providing an option of correcting one of the fuel signal and the air signal depending on the operating state, wherein the option of correcting the one of the fuel signal and the air signal is provided based on which signal has a greatest error for the operating state.

* * * * *